US010808471B2

(12) United States Patent
Begnaud et al.

(10) Patent No.: US 10,808,471 B2
(45) Date of Patent: Oct. 20, 2020

(54) POWER TONG TORQUE REACTION SYSTEM

(71) Applicant: Frank's International, LLC, Houston, TX (US)

(72) Inventors: Brian Begnaud, Lafayette, LA (US); Dax Joseph Neuville, Broussard, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 122 days.

(21) Appl. No.: 16/291,361

(22) Filed: Mar. 4, 2019

(65) Prior Publication Data

US 2019/0277098 A1 Sep. 12, 2019

Related U.S. Application Data

(60) Provisional application No. 62/641,319, filed on Mar. 10, 2018.

(51) Int. Cl.
*E21B 19/16* (2006.01)

(52) U.S. Cl.
CPC ..... *E21B 19/161* (2013.01); *E21B 19/166* (2013.01)

(58) Field of Classification Search
CPC ..... E21B 19/161; E21B 19/166
See application file for complete search history.

(56) References Cited

U.S. PATENT DOCUMENTS 4,972,741 A 11/1990 Sibille
5,099,725 A 3/1992 Bouligny, Jr. et al.
5,842,390 A * 12/1998 Bouligny ..... E21B 19/161 81/57.34
6,138,776 A * 10/2000 Hart ..... E21B 19/161 166/77.53
6,142,040 A 11/2000 Bouligny
6,270,136 B1 8/2001 Dagenais
6,386,284 B1 5/2002 Buck et al.
7,367,402 B1 5/2008 Bangert
2004/0049905 A1 3/2004 Jansch et al.
(Continued)

OTHER PUBLICATIONS

Extended European Search Report dated Aug. 1, 2019, EP Application No. 19161137, pp. 1-6.
(Continued)

*Primary Examiner* — D. Andrews
(74) *Attorney, Agent, or Firm* — MH2 Technology Law Group LLP

(57) ABSTRACT

A tubular connecting system includes a tong configured to apply a torque on an upper tubular, to torque a connection of the upper tubular to a lower tubular, a torque linkage extending at least partially vertically from the tong, the torque linkage being configured to transmit a force or force-pair, or pure torque, generated by the tong applying the torque to the upper tubular, a transmission plate removably coupled to the torque linkage so as to transmit linear forces thereto, therefrom, or both, the transmission plate being configured to receive the lower tubular therethrough, and a landing plate removably coupled to the transmission plate and configured to engage the lower tubular. The landing plate is configured to counteract the torque as it is applied to the lower tubular by the tong.

22 Claims, 9 Drawing Sheets

(56) References Cited

U.S. PATENT DOCUMENTS

2005/0235780 A1* 10/2005 Dagenais ..... E21B 19/164
81/57.35
2008/0307932 A1* 12/2008 Lauzon ..... E21B 19/161
81/69

OTHER PUBLICATIONS

Frank's Interational, Zero Side Load Reaction System, Frank's International, 2015, pp. 1-2.

* cited by examiner

POWER TONG TORQUE REACTION SYSTEM

CROSS-REFERENCE TO RELATED APPLICATIONS

This application claims priority to U.S. Provisional Patent Application having Ser. No. 62/641,319, which was filed on Mar. 10, 2018 and is incorporated herein by reference in its entirety.

BACKGROUND

In oilfield tubular-running operations, lengths of pipe are joined together, end-on-end, to form a tubular string (e.g., drill string, casing string, production string, etc.) that is progressively fed into a wellbore. In some drilling rig operations such as running a tubular string into the wellbore, a spider with slips is used to grip and support the outer diameter (OD) of the tubular string at the rig floor.

In some cases, a landing plate is used to support lower horizontal face of the collars that are used to join together individual tubular segments that makeup the tubular string. The landing plate, similar to the slip-type spider, is positioned at the rig floor. In both the case of the slip-type spider and the landing plate, the tubular string is supported at or near the rig floor. An elevator is employed to lift the add-on sections of pipe (or stands of two or more pipes) into position, such that the lower threaded connection of the add-on section is aligned with the coupling collar of the uppermost section of the previously-run string, which is supported at the rig floor by either the spider or the landing plate. Next, tongs are employed to make-up the threaded connection between the portion of the tubular string that is support at the rig floor and the add-on tubular section by gripping and rotating the add-on pipe section. This connects the threads of the add-on tubular section with the portion of the string that is supported by either the landing plate or the slip-type spider, in order to provide a fully-torqued connection therebetween. The process may be repeated for each add-on pipe segment (or each stand) in the string.

Power tongs have come into widespread use to facilitate this make-up process. Power tongs have bodies in which pipe-gripping jaws with dies rotate relative to the tong frame and about the gripped pipe centerline. Early power tongs had a torque arm snubbed to a rig structure to provide suitable anchor point to resist the lateral side load being generated by the power tong as the power tong applies torque to make-up the threaded connection. Methods used to resist the torque being applied by the power tong include the use of a non-powered rig tong or the slip-type spider equipped with powered slips.

Tong sets have been introduced that employ two tongs: a main powered tong that rotates the upper pipe section, and a back-up tong that engages the lower pipe and provides an anchor point to keep the power tong rotationally stationary as the power tong applies torque to the threaded connection. The two tongs may be close-coupled and thus transmit the torque to the pipe coupling therebetween while reacting lateral forces thru the structure that join the power tong to the back-up tong.

Tong sets that employ both a power tong and a backup tong are further divided into two basic types: a simple single lateral reactive force type and a Zero Side Load (ZSL) type. In the former, powered main tong and back-up tong sets react torque between the power tong and the back-up tong via a single point of contact between the two tongs. As a result, these main tong and back-up tong sets impart a bending moment and a side load on the pipe connection being made up. Accordingly, the Zero Side Load (ZSL) type reaction systems have been implemented, which provide two points of contact between the power tong and the back-up tong for force transmission between the two tongs. The ZSL type reaction system generates two parallel, offset, and opposite forces on the between the power tong and the back-up tong, which results in the application of pure torque and generally avoids the introduction of damaging side loads to the threaded connection during the makeup process.

SUMMARY

A tubular connecting system is disclosed. The system includes a tong configured to apply a torque on an upper tubular, to torque a connection of the upper tubular to a lower tubular, a torque linkage extending at least partially vertically from the tong, the torque linkage being configured to transmit a force or force-pair, or pure torque, generated by the tong applying the torque to the upper tubular, a transmission plate removably coupled to the torque linkage so as to transmit linear forces thereto, therefrom, or both, the transmission plate being configured to receive the lower tubular therethrough, and a landing plate removably coupled to the transmission plate and configured to engage the lower tubular. The landing plate is configured to counteract the torque as it is applied to the lower tubular by the tong.

A method for reacting torque is disclosed. The method includes receiving a lower tubular partially into a wellbore. An upper end of the lower tubular segment is connected to a collar. The method also includes supporting a weight of the lower tubular by engagement between a landing plate of a tubular connection system and the collar, lowering an upper tubular into engagement with the collar, receiving a tong of a tubular connection system around the upper tubular. The tubular connection system further includes a torque linkage extending at least partially vertically from the tong, and a transmission plate removably coupled to the torque linkage so as to transmit linear forces thereto, therefrom, or both. The landing plate is removably coupled to the transmission plate. The method further includes rotating the upper tubular relative to the lower tubular and the collar using the tong so as to connect the upper tubular to the lower tubular via the collar. The torque is reacted from the tong, through the torque linkage and the transmission plate, and from the lower tubular through the landing plate and to the transmission plate.

A tubular connecting system is further disclosed. The system includes a tong configured to apply a torque on an upper tubular, to torque a connection of the upper tubular to a lower tubular, a torque linkage extending at least partially vertically from the tong, the torque linkage being configured to transmit a force or force-pair, or pure torque, generated by the tong applying the torque to the upper tubular, the torque linkage including first and second arms that are vertically aligned and horizontally offset, and a transmission plate removably coupled to the torque linkage so as to transmit linear forces thereto, therefrom, or both. The transmission plate is configured to receive the lower tubular therethrough, and the first and second arms are coupled to the transmission plate, such that the first and second arms are substantially in compression or substantially in tension when torque is applied by the tongs to the upper tubular. The system also includes a landing plate removably coupled to the transmission plate and configured to engage the lower tubular. The landing plate is configured to provide to counteract the torque being applied to the lower tubular by the tong, and the landing plate includes a torque-transmission feature that engages a coupling collar of the lower tubular and reacts a force generated by torque on the coupling collar to the transmission plate.

BRIEF DESCRIPTION OF THE DRAWINGS

The accompanying drawings, which are incorporated in and constitutes a part of this specification, illustrate an embodiment of the present teachings and together with the description, serve to explain the principles of the present teachings. In the figures.

Figure 1:
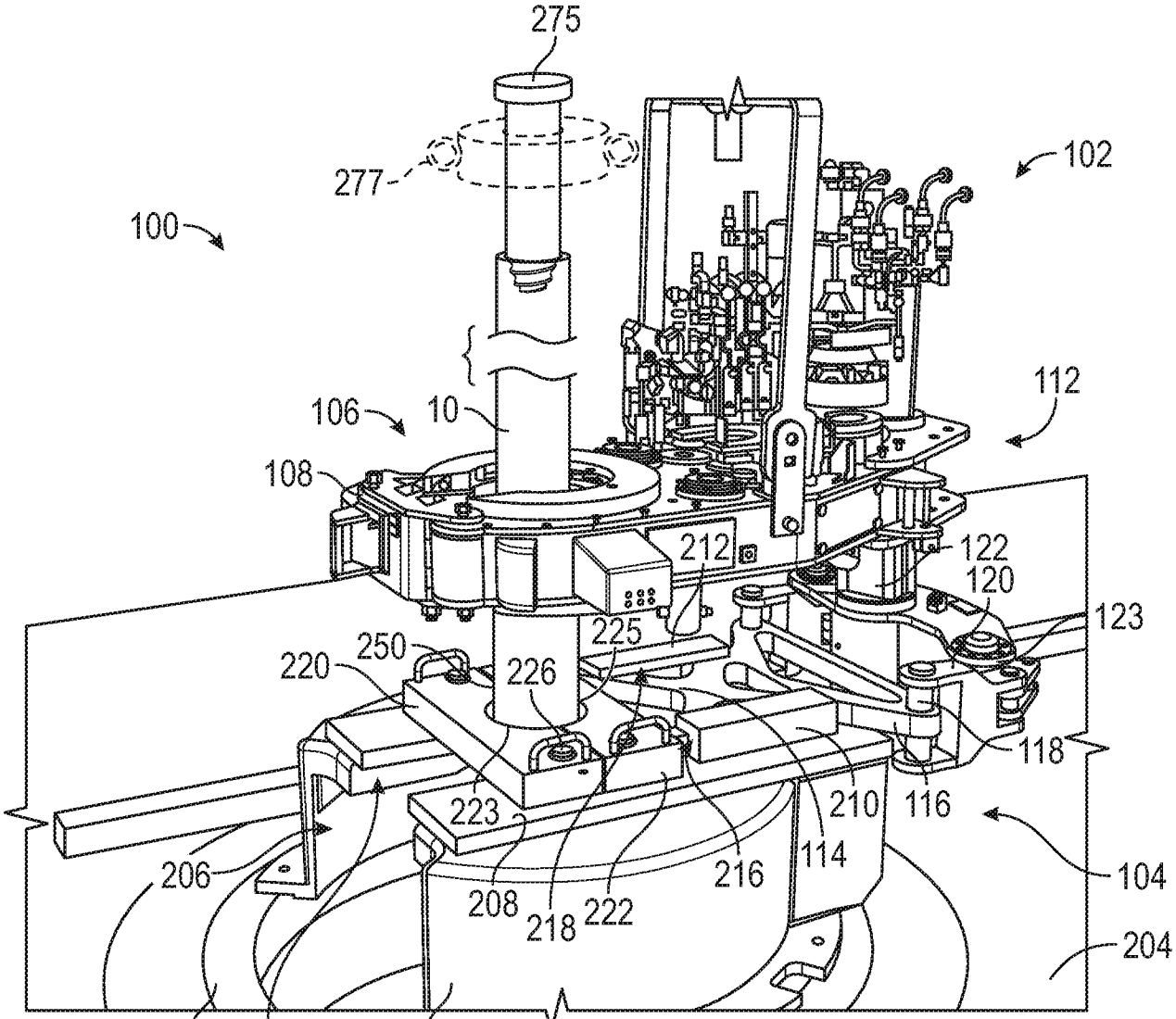
FIG. 1 illustrates a perspective view of a tubular connecting system, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Embodiments of the present disclosure include a tong and a back-up assembly that is particularly useful, but not by way of limitation, when making up a series of downhole screen assemblies and screen assemblies to production tubulars. These porous screens allow for fluid to flow from the formation into the wellbore, while keeping sand and other unwanted material from entering the tubular. These screens are delicate structures that can be damaged if engaged by gripping assemblies like tongs, elevators, or spiders with gripping teeth. When joining lengths of pipe that contain these screen assemblies, some length of solid pipe surface area is made available for the tong and/or back up tong to grip. However, this solid pipe area is minimal, so that the amount of space along the pipe can be mostly provided by screens.

FIG. 1 illustrates a perspective view of a tubular connecting system 100, according to an embodiment. The tubular connecting system 100 may be configured for use on an oil rig in some embodiments. For example, the tubular connecting system 100 may be configured to connect an upper tubular 10 to a collar 250 connected to a lower tubular 12 (not visible in FIG. 1) by rotating the upper tubular 10 into threaded connection with the previously run lower tubular 12 (e.g., via a collar or integral connection, as will be described below). The lower tubular 12 may be a "stump" or upper end of a casing string, or production tubing string, including portions of the production tubing string including downhole screen assemblies that were previously run into the wellbore. The upper tubular 10 may be a pipe or stand of two or more pipes that are being connected to the tubular string, and run into the wellbore, so as to extend the tubular string.

The tubular connecting system 100 may include a tong assembly 102 and a back-up assembly 104. The tong assembly 102 may include a power tong 106, which may include a tong body 108 that is configured to be received around the upper tubular 10 (e.g., drill pipe, casing or production tubing), and may be configured to engage the upper tubular 10 and rotate the upper tubular 10 with respect to the tong body 108. It will be appreciated that tong 106 may be received in a lateral direction around the upper tubular 10, from any direction.

The tong assembly 102 may also include a torque linkage 112 coupled to the tong body 108 and, for example, extending downward therefrom. In some embodiments, the tong assembly 102 may also include a torque plate 114 that is coupled to the torque linkage 112. In other embodiments, the torque plate 114 may be omitted, as will be described in greater detail below.

In an embodiment, the torque plate 114 may be connected to the torque linkage 112 via two connecting members 116 that receive pins 118 therethrough. The connecting members 116 may be an integral part of the torque plate 114, or may be separate and secured (e.g., welded) thereto. The pins 118 secure the connecting members 116 of the torque plate 114 to arms 120 of the linkage 112. In some embodiments, the arms 120 may be vertically aligned and horizontally offset, and may extend horizontally to a connection with a post 122 of the linkage 112, and thus may avoid creating a moment arm in the vertical direction. The arms 120 may be connected to bellcranks 123, providing a pivotal connection for the arms 120, which may serve to maintain forces incident on the arms 120 in pure compression or pure tension. In other embodiments, the bellcranks 123 may be substituted with rigid connections, as will be described in greater detail below.

The back-up assembly 104 may include a spider that may be connected to a rotary table 202. The rotary table 202 may be rotatable relative to the rig floor 204, and may include the spider, with supporting top cover 200, for gripping the lower tubular 12 therein. In some embodiments, the spider may support all or some of the vertical weight of the lower tubular 12, but in other embodiments, the spider may not grip the lower tubular 12, particularly in situations where delicate screen assemblies are present in the lower tubular 12. The top cover 200 may extend upwards from the rotary table 202 and may be rotatable therewith (but may be constrained from such rotation by interaction with the lower tubular 12 and the back-up assembly 104). The top cover 200 may also include a slot 206 therein, through which the lower tubular 12 may be received into the wellbore.

A transmission plate 208 may be coupled to the top cover 200, e.g., to the top of the spider, as shown. In some embodiments, the transmission plate 208 may be a single plate, but in other embodiments, may be two or more plates that are coupled together. The transmission plate 208 may include a pair of sidewalls 210, 212, which may be spaced laterally apart and may extend generally parallel to one another. The torque linkage 112 may be removably connected to the transmission plate 208 and configured to transmit torque therewith, e.g., through two points of contact. For example, the torque plate 114 of the tong assembly 102 may fit between the sidewalls 210, 212, such that reactionary torque during makeup of the threaded connection is transmitted between the sidewalls 210, 212 and the torque plate 114, and to the linkage 112 via the two arms 120.

The sidewalls 210, 212 may, in some embodiments, define channels 216, 218, respectively, as shown, and the torque plate 114 may slide into position therein (FIG. 1 illustrates the torque plate 114 partially slide therein). A slot 214 may be defined through the transmission plate 208, at least partially aligned with the slot 206, through which the spider or table 202 may be received onto existing tubular. In some embodiments, the sidewalls 210, 212 may extend on opposite sides of the slot 214. In other embodiments, the sidewalls 210, 212 may terminate at or proximate to the slot 214, as shown.

The back-up assembly 104 may also include two or more landing plates 220, 222, which may be removably coupled to the transmission plate 208 so as to transmit lateral forces therebetween. Although two plates 220, 222 are depicted, it will be appreciated that any number of plates is within the scope of the present disclosure. In the illustrated embodiment, the landing plates 220, 222 each include a generally semicircular cutout 223, 225, which is shaped to be received around the lower tubular 12. Pins 226 or any other suitable fastening or holding devices may be employed to maintain the landing plates 220, 222 in place, e.g., in contact with the transmission plate 208 and the lower tubular 12. In other embodiments, the sidewalls 210, 212 may extend farther than illustrated, past the lower tubular 12, and the landing plates 220, 222 may engage the sidewalls 210, 212. The landing plates 220, 222 may be configured to transfer torque incident on the collar 250 to lateral forces on the transmission plate 208, which may ultimately be balanced with reactionary loads transmitted from the tong 106 via the torque linkage 112. Such torque balancing and transmission is described in greater detail below.

Figure 2A:
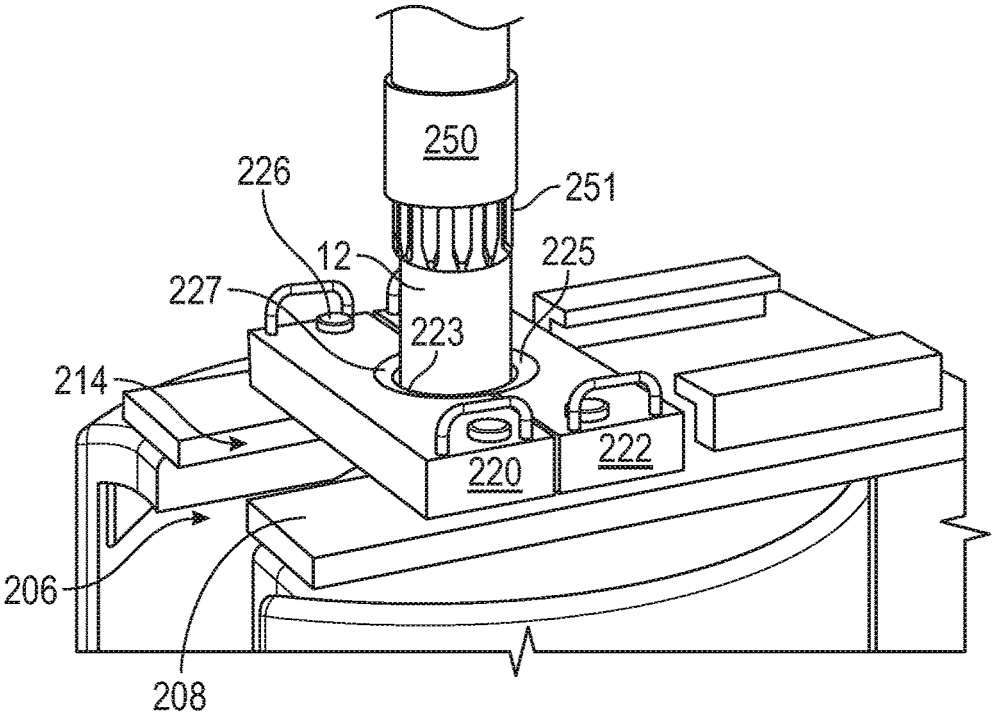
FIG. 2A illustrates a perspective view of a tubular including a, coupling collar, and a previously-installed joint positioned above a landing plate assembly portion of a back-up assembly of the tubular connecting system, according to an embodiment.
Figure 2B:
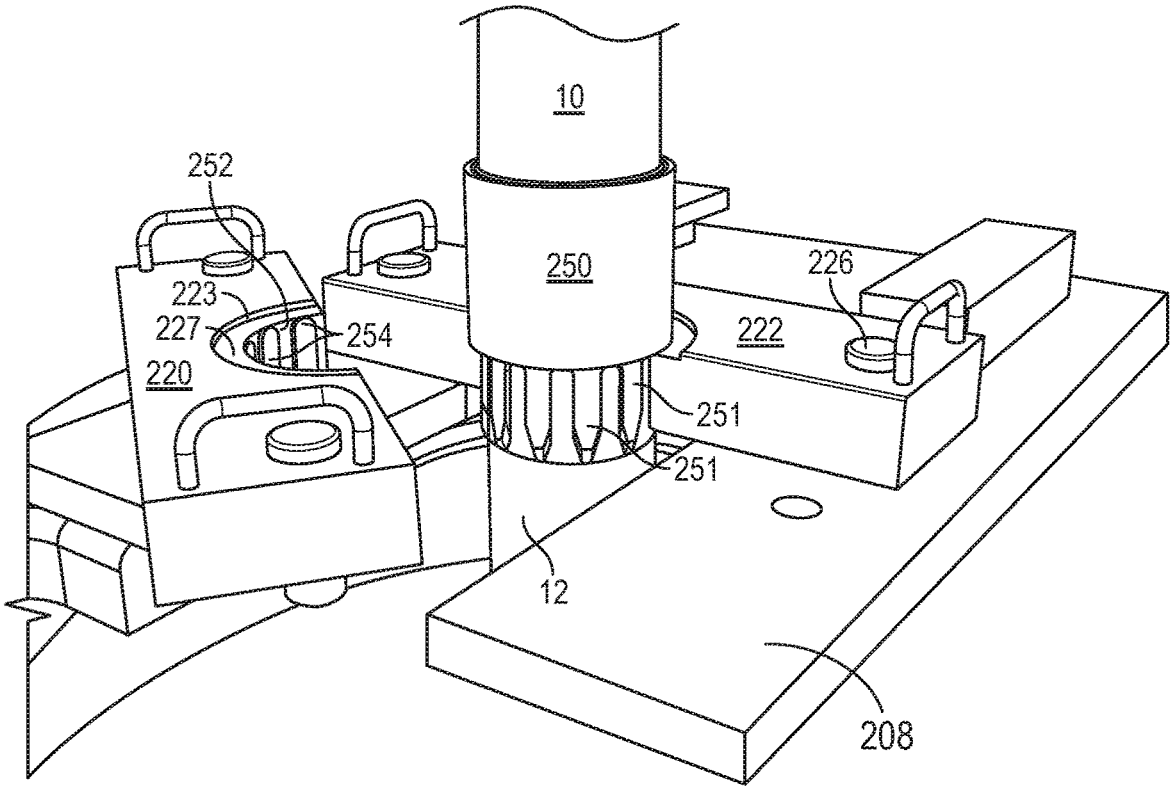
FIG. 2B illustrates a perspective view of the lower tubular landed on a single segment of landing plate portion of the back-up assembly, but with one of the landing plate segments swung away from the other, for the sake of illustration, according to an embodiment.

FIGS. 2A illustrates an enlarged perspective view of the lower tubular 12 just before a coupling collar 250 thereof is landed on the landing plate. FIG. 2B illustrates the coupling collar 250 of the lower tubular 12 landed in the landing plate 222 with the landing plate 220 removed for clarity respectively, according to an embodiment. In FIG. 2B, the landing plate 220 is pivoted away from the landing plate 222 to illustrate an inner diameter surface of the landing plates 222. In practice, this landing plates 220, 222 are coupled to the transmission plate 208 when supporting the coupling collar 250 and swung open or laterally moved open to permit lowering of the tubular string including coupling collar 250 thru the landing plates 220, 222. In some embodiments, the coupling collar 250 may be a separate collar, but in other embodiments, may be an integral part of the lower tubular 12.

The collar 250 includes a torque-transmission feature, and the landing plates 220, 222 include a complementary torque-transmission feature. Together, the torque-transmission features are configured to react torque applied to the collar 250 to torque generation load couples on the landing plates 220, 222. For example, the torque-transmission feature of the lower portion of the coupling collar 250 may include a plurality of splines 251. The splines 251 may be formed directly as a part of the collar 250, or may be formed as a part of a separate collar that is threaded to the lower tubular 12 and provides the coupling collar 250. Both cases are consistent with the description of the splines 251 as being part of a torque-transmission feature of the collar 250 herein.

At least a portion of an inner diameter surface 252, defined by one or both of the cutouts 223, 225 of the landing plates 220, 222 may include complementary splines 254, thereby providing the torque-transmission feature of the landing plates 220, 222. When meshed together, the splines 251 of coupling 250 and the splines 254 of landing plates 220,222 may form a spline coupling, which allows the lower tubular 12 to be held rotationally stationary as the upper tubular 10 is threadedly connected at the coupling 250.

Various other types of torque-transmission features are also contemplated. For example, flats, polygonal cross-sections, keys, posts, etc. may be provided to transfer the torque on the lower tubular 12 to lateral forces that create torque reacting function on the landing plates 220, 222.

Further, the landing plates 220, 222 may also define a bushing by provision of the cutouts 223, 225, which may be flat or tapered, e.g., providing a shoulder 227, as shown. The cutouts 223, 225, when the landing plates 220, 222 are received around the lower tubular 12 and fastened into place, may be aligned with the slots 206, 214, so as to provide a pathway for the spider or table 202 to be deployed to the center of the wellbore with a tubular string in the wellbore. The landing plates 220, 222 may thus be configured to support at least some of the axial load applied by the weight of the lower tubular 12. In some embodiments, the spider top cover 200, transmission plate 208, and landing plates 220, 222 may take up substantially all of the axial load of the assembled tubular string.

Referring now again to FIG. 1, in an example of operation, to connect the upper tubular 10 to the lower tubular 12, the lower tubular 12 and collar 250 may be received vertically and lowered through the spider, into the wellbore. Before or during such lowering, the landing plates 220, 222 may be positioned on opposite sides of the lower tubular 12 and secured to the transmission plate 208. FIG. 2A illustrates the coupling collar 250 and the landing plates 220, 222 at this point. Additionally, a lift nubbin 275 (or lift sub) may be assembled into the upper collar 250. The lift nubbin 275 may be pre-installed to the top of each joint (or stand of two or more joints). An elevator 277 may be secured to the lift nubbin or lift sub 275, as shown.

As shown in FIG. 2B (e.g., but with the landing plate 220 secured fully in place to the transmission plate 208), the coupling collar 250 of the lower tubular 12 may then be lowered into engagement with the landing plates 220, 222, such that the torque transmitting feature of the collar 250 engages the torque transmitting feature of the landing plates 220, 222, e.g., the splines 251, 254 mesh.

Referring again to FIG. 1, the lift nubbin 275 or sub may be removed, at which point the upper tubular 10 may then be brought in and threaded into the collar 250 of the lower tubular 12. To make-up and/or fully torque this connection, the tongs 106 may be received around the upper tubular 10. As the tongs 106 are brought laterally toward and then received around the upper tubular 10, the torque plate 114 may be slid into the channels 216, 218. The torque plate 114 may or may not abut against the landing plate 222.

The tong 106 may then be actuated to make up the threaded connection between the upper tubular 10 and the collar 250. FIGS. 3-6 illustrate free-body diagrams of various components of the tubular connecting system 100, according to an embodiment, which may provide a better understanding of the operation of the present embodiment.

Figure 3:
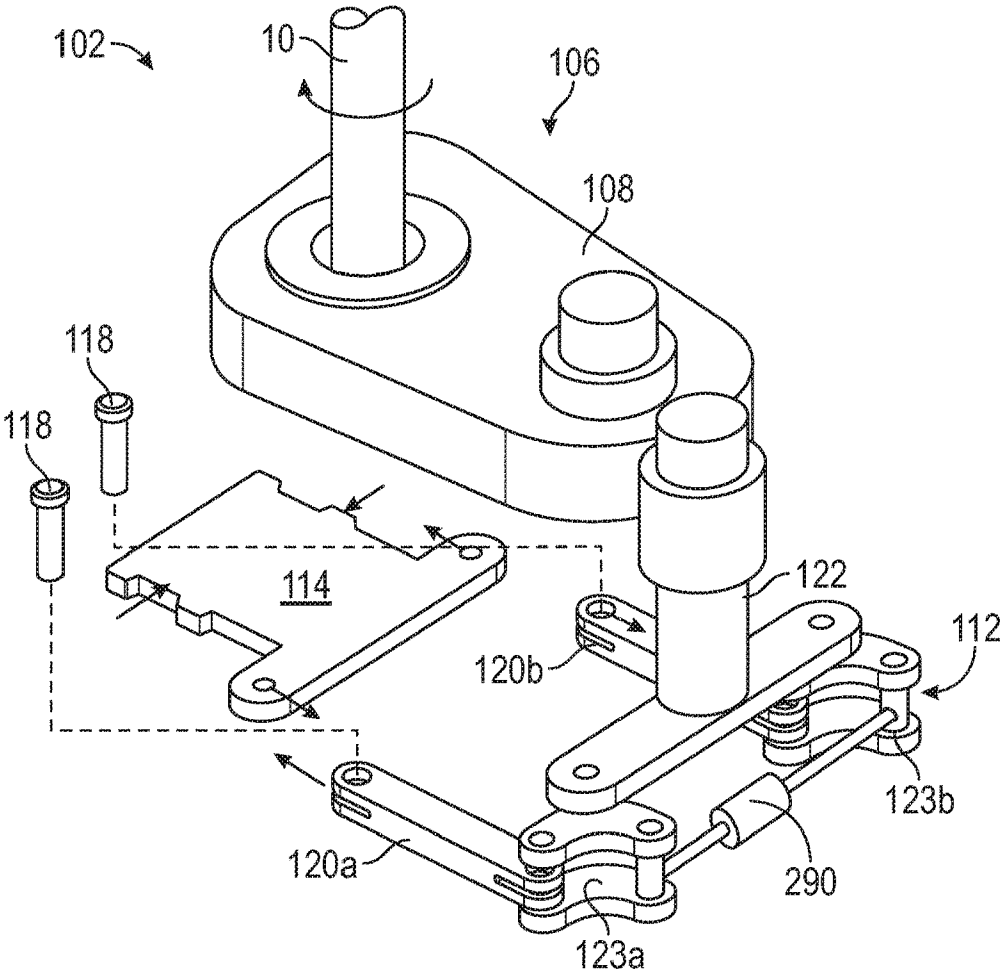
FIG. 3 illustrates a partially-exploded, perspective view of a tong assembly of the tubular connecting system, showing forces incident thereon which are imposed during the threaded connection makeup process, according to an embodiment.

In particular, FIG. 3 illustrates a free-body diagram of the components of the tong assembly 102, according to an embodiment. As shown, the tong 106 grips and rotates the upper tubular 10, e.g., clockwise to threadedly connect the tubulars 10, 12. It will be appreciated that the tong assembly 102 may also be employed to break-apart connections, by rotating the upper tubular 10 in the opposite direction. The torque imparted by the tongs 106 onto the upper tubular 10, typically rotated clockwise to make up a connection, is transmitted via the linkage 112 to the torque plate 114. In particular, a force couplet is experienced at the arms 120, with one arm 120B being substantially or purely in compression and one arm 120A being substantially or purely in tension, as shown. These forces are transmitted to the torque plate 114, which engages the sidewalls 210, 212 (FIG. 1), producing another force couplet, generally perpendicular to the couplet on the linkage 112.

During such make up force transmission, the arms 120A, 120B pivot about the bellcranks (two are now visible: 123A, 123B), such that a load cell 290 therebetween is maintained in tension, allowing for a measurement of the forces incident thereon. It will be appreciated that, in this same setup, a break out force transmission will apply a compression load on the load cell.

Figure 4:
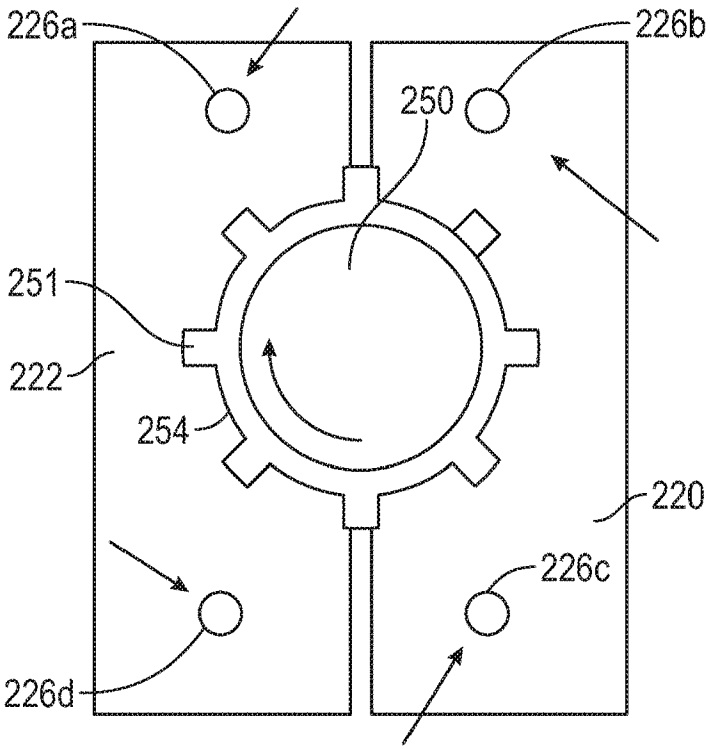
FIG. 4 illustrates a plan view of the landing plates and coupling collar, showing the forces incident on a transmission plate of the back-up assembly which are imposed during the threaded connection makeup process, according to an embodiment.

FIG. 4 illustrates a free-body diagram of the landing plates 220, 222, according to an embodiment. The torque on the coupling collar 250 is transmitted to the landing plates 220, 222 via the torque-transmission features (e.g., meshing splines 251, 254). The pins 226A, 226B, 226C, 226D securing the landing plates 220, 222 to the transmission plate 208 (e.g., FIG. 1) provide reactionary, linear forces, the lateral components of which form offset force couplets, thereby reacting the torque applied by the coupling collar 250.

Figure 5:
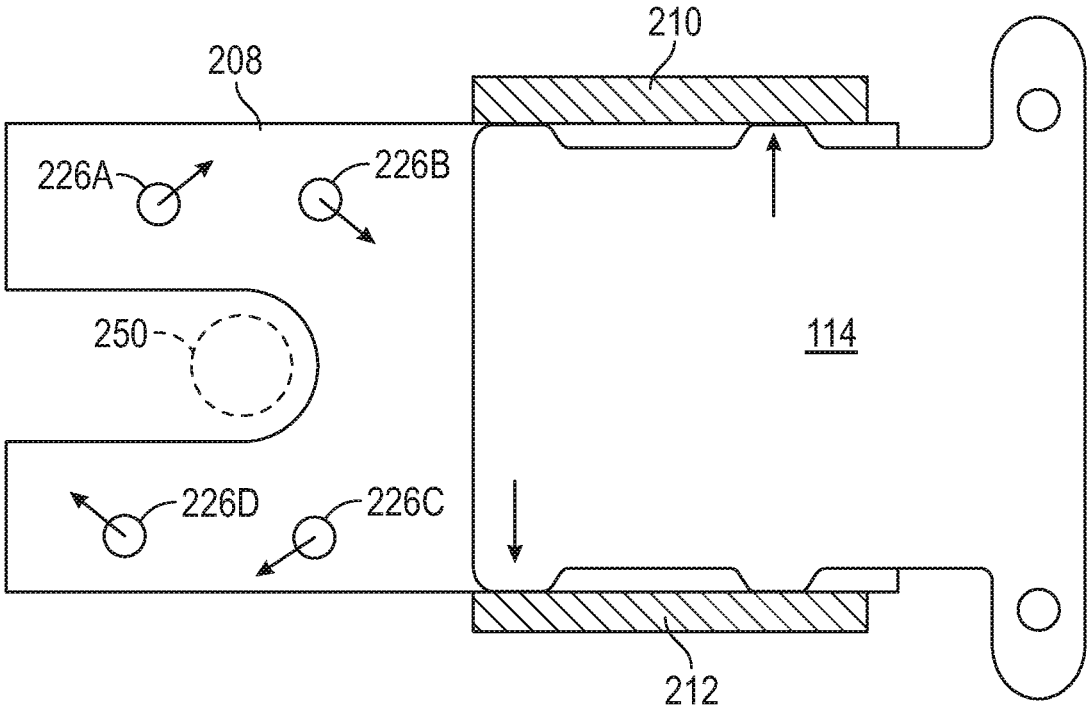
FIG. 5 illustrates a free-body diagram of the transmission plate, showing forces applied to the landing plates by the torque plate that are imposed during the threaded connection makeup process, according to an embodiment.
Figure 6:
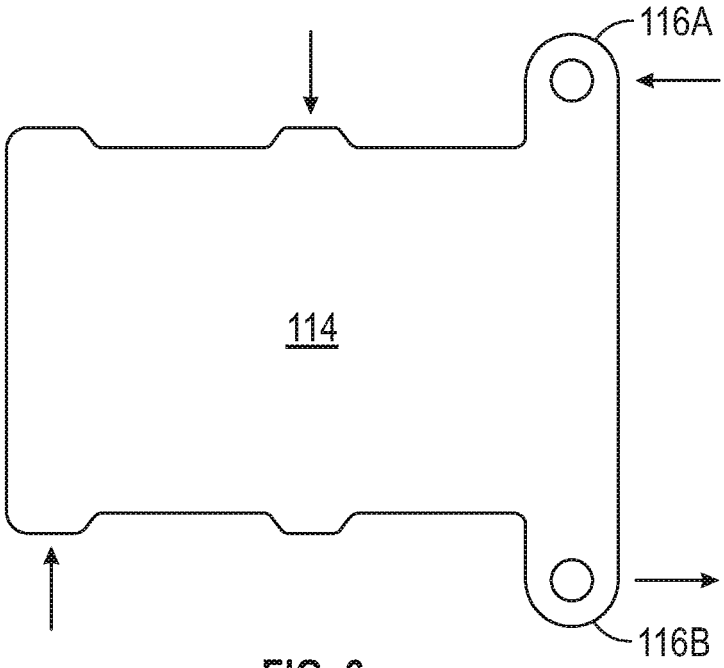
FIG. 6 illustrates a plan view of the torque plate, showing forces applied by the tong's reaction system that are imposed during the threaded connection makeup process, according to an embodiment.

Referring now to FIG. 5, the forces incident on the transmission plate 208, including the sidewalls 210, 212, are shown. In particular, the landing plates 220, 222 (FIG. 4), via the pins 226A-D apply reactionary, linear forces to the transmission plate 208, equal and opposite to those forces shown in FIG. 4. The torque plate 114 applies a horizontal (up and down as shown in this plan view) force couplet against the sidewalls 210, 212, which apply equal and opposite forces, as shown in FIG. 6. Thus, the transmission plate 208 essentially closes the loop on the torque applied to the upper tubular 10 by the tong 106. The torque applied thereto is reacted to the transmission plate 208 via the landing plates 220, 222, and the reactionary torque on the tong 106 experienced by providing such torque on the upper tubular 10, is also reacted to the transmission plate 208 by the linkage 112 and (in this embodiment) the torque plate 114. The torque-generated forces thus cancel out with no or substantially no side loads incident on the linkage and no or substantially no bending moments on the tubulars 10, 12 or the back-up assembly 104.

Figure 7:
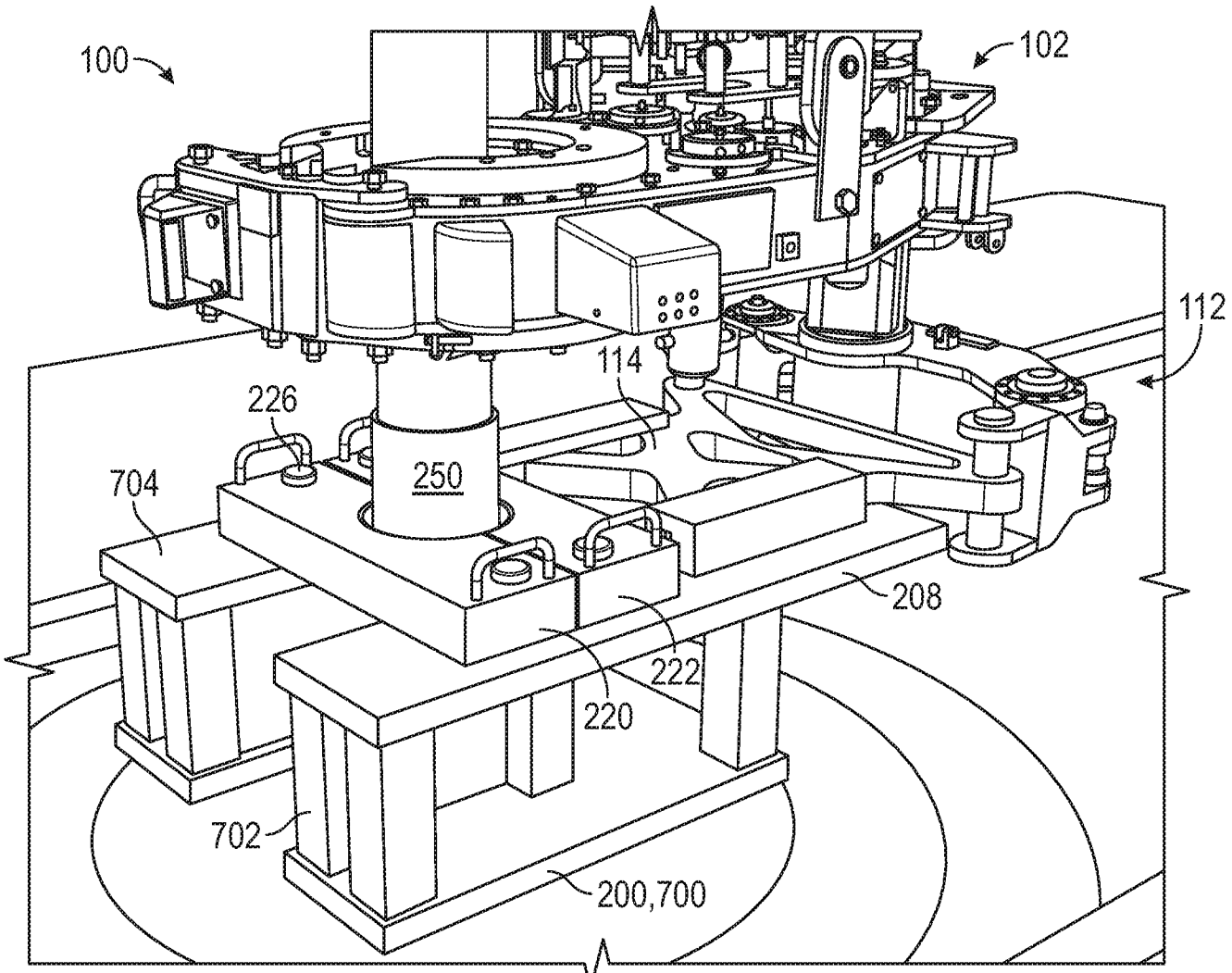
FIG. 7 illustrates a perspective view of the tong assembly of the tubular connecting system, showing the landing plate being supported by a table structure rather than being supported by the top cover of a spider, according to an embodiment.

FIG. 7 illustrates a perspective view of the tubular connecting system 100, according to another embodiment. As shown, the spider and associated top cover 200 (e.g., FIG. 1) are replaced by a table 700. The table 700 may be configured to support an axial load, e.g., at least a portion of the weight of the lower tubular 12 (and any tubulars connected thereto) via the landing plates 220, 222. Accordingly, the table 700 may include several robust legs 702 extending vertically upwards to a top 704. The top 704 may serve as or be fixed in connection to the transmission plate 208. The embodiment of FIG. 7 may generally operate in the same manner discussed above with respect to FIGS. 1-6.

Figure 8:
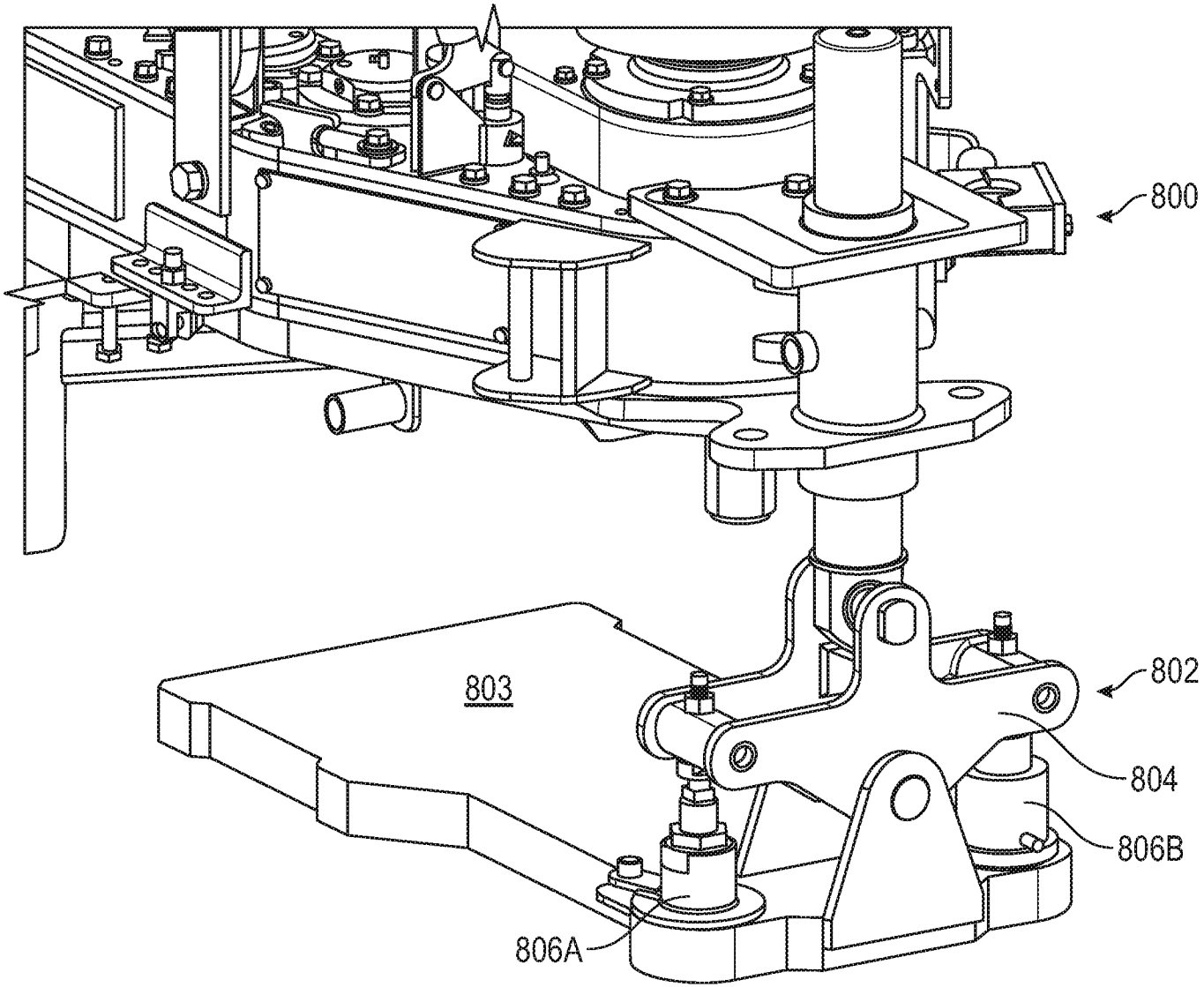
FIG. 8 illustrates a partial perspective view of another embodiment of the tubular connecting system, showing the torque linkage of a single point conventional tong torque reaction system.
Figure 9:
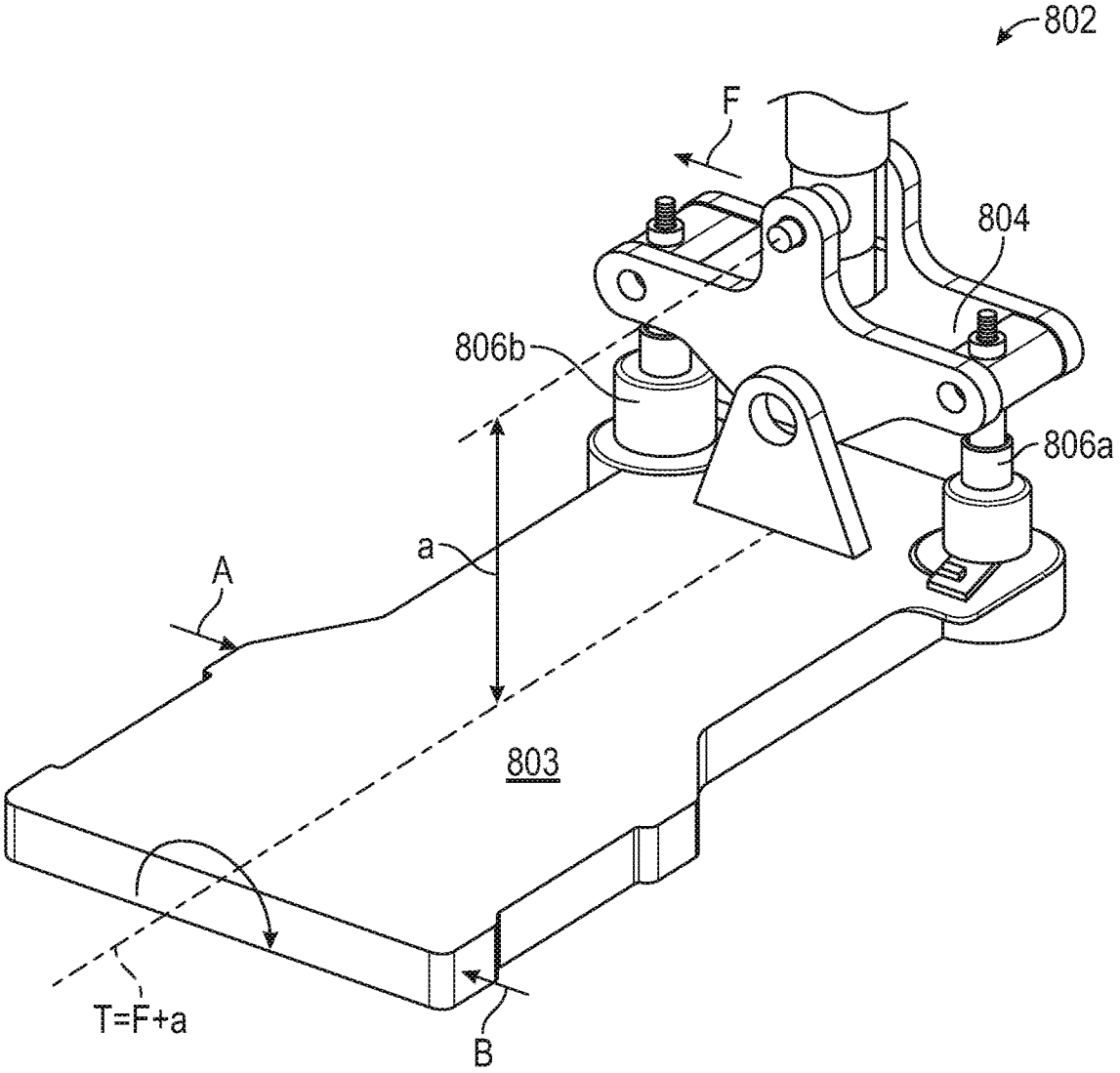
FIG. 9 illustrates a free-body diagram of the torque plate and the torque linkage of the embodiment of FIG. 8.
Figure 10A:
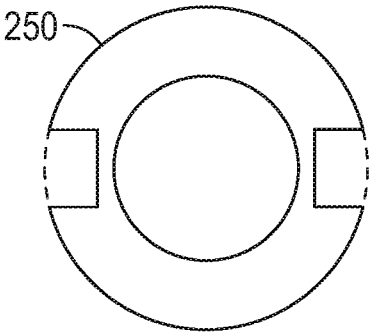
FIGS. 10A, 10B, 10C, 10D, 10E illustrate cross-sectional views of additional embodiments of the coupling collar's torque reacting feature.
Figure 10B:
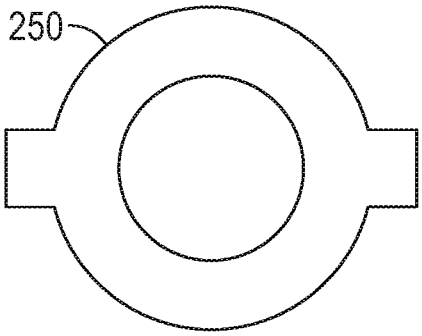
Figure 10C:
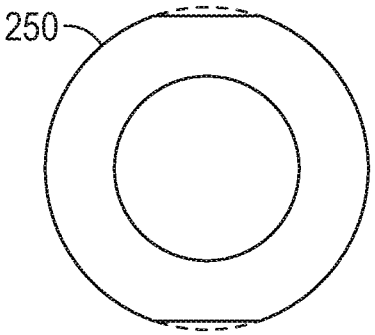
Figure 10D:
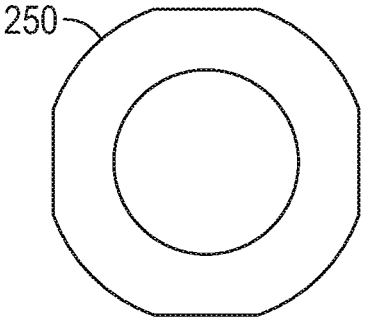
Figure 10E:
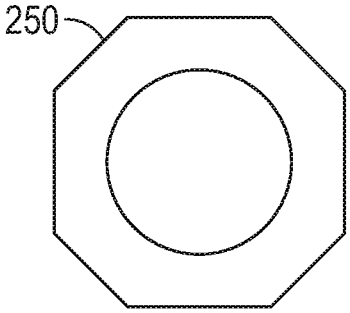

In some situations, cost and/or design simplicity may dictate that some side load/roll torque at the coupling may be tolerable. Accordingly, FIGS. 8 and 9 illustrate a portion of another tong assembly 800, which may be similar in operation to the tong assembly 102 discussed above. Like the tong assembly 102, the tong assembly 800 may have a torque linkage 802 that connects with a torque plate 803, which transmits loads therebetween. A bellcrank 804 may contact a compression load cell 806B when torqueing in the make-up direction, or a dummy load cell 806A when torqueing in the break out direction, both of which load into the torque plate 803.

Lateral forces A, B may be incident on the torque plate 803, as shown. However, the force A may be greater than the force B, resulting in a net force on the bellcrank 804. This net force F represents a side load experienced by the connection threads. Furthermore, the side load force incident on the bellcrank 804 is vertically offset from the forces incident on the torque plate 803, resulting in the illustrated roll torque T. This roll torque may be mitigated by positioning the bellcrank 804 in or near the same vertical plane as the torque plate 803, but that may also serve to add additional leverage and roll torque on the tong 102 connection to upper tubular side loads.

FIGS. 10A-10E illustrate different shapes for a cross-section of the coupling collar 250, which may provide different embodiments of the torque transmission feature thereof. As shown, the coupling collar 250 may have slots, keys, two flats, four flats, six flats, etc., to facilitate transmission of torque to a complementarily shaped torque transmission feature of the landing plates 220, 222.

Figure 11:
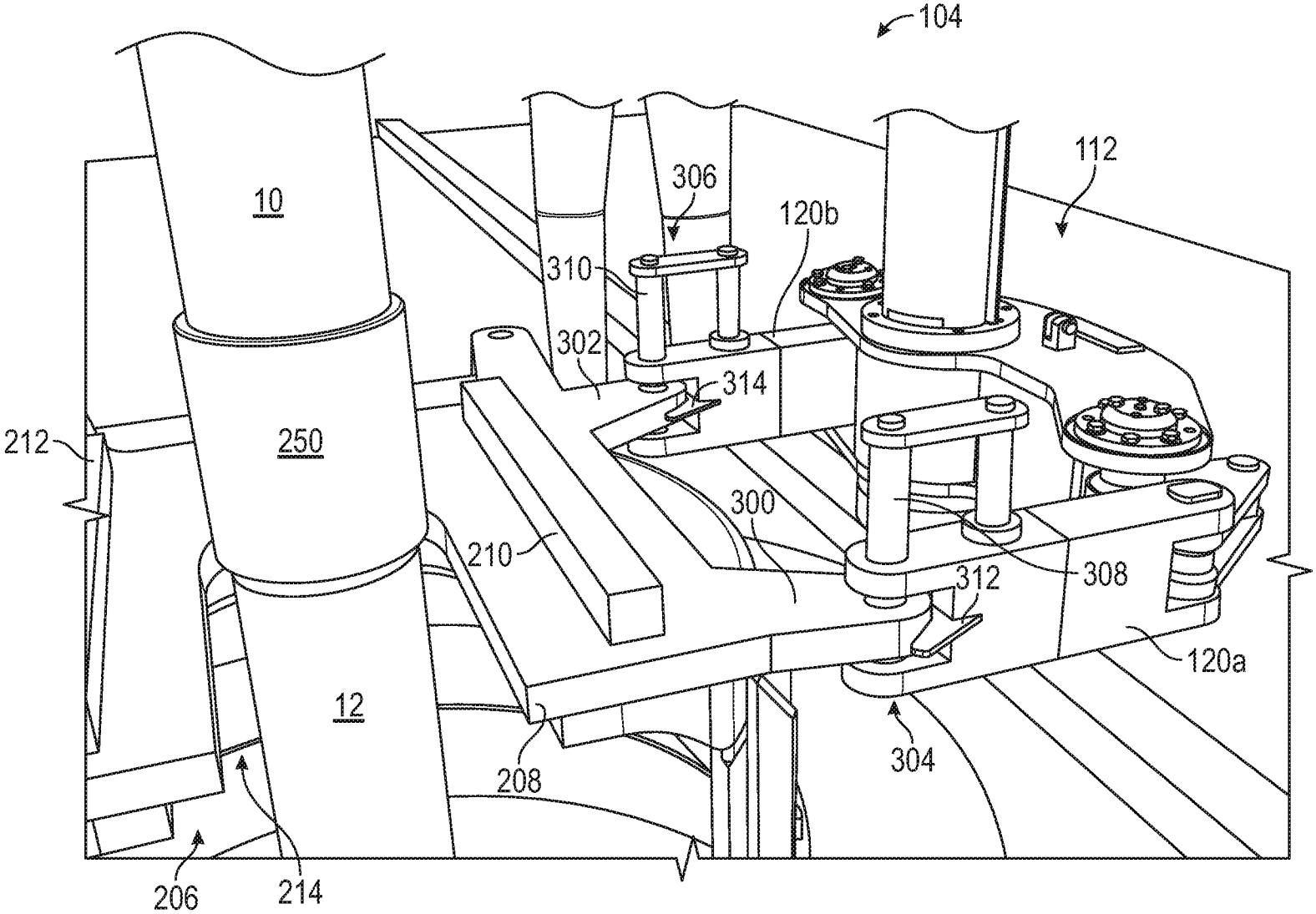
FIG. 11 illustrates a perspective view of another embodiment of the tubular connecting system.

FIG. 11 illustrates a perspective view of a portion of the back-up assembly 104, according to another embodiment. In this embodiment, the torque plate 114 (e.g., FIG. 1) is omitted. As such, two points of connection are provided between the linkage 112 and the transmission plate 208. Moreover, rather than engaging the transmission plate 208 in the same lateral direction as the slots 206, 214, the arms 120 may engage the transmission plate 208 from a direction perpendicular to the slot 206, 214, or in any other direction.

In the illustrated embodiment, the transmission plate 208 may include two connection members 300, 302, which may each define a hole therethrough. The arms 120A, 120B may have connections 304, 306 configured to receive the connection members 300, 302, respectively. The connections 304, 306 may have actuatable pins 308, 310, e.g., connected to a hydraulic (or another suitable type of) driver, which is configured to raise and lower the pins 308, 310 through the holes in the connection members 300, 302. The connections 304, 306 further include guide plates 312, 314, which may be shaped to engage the periphery of the connection members 300, 302, and guide the connections 304, 306, such that the pins 308, 310 are in alignment with the holes in the connection members 300, 302. Once aligned, the pins 308, 310 may be driven through the holes, thereby connecting the arms 120A, 120B to the transmission plate 208.

In this view, the landing plates 220, 222 (e.g., FIG. 1) are omitted for the sake of clarity. However, it will be appreciated that the landing plates 220, 222 may be positioned on the transmission plate 208 and held in place using pins or the like, and/or may bear directly against the sidewalls 210, 212, in order to transmit torque to/from the transmission plate 208.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A tubular connecting system, comprising:

a tong configured to apply a torque on an upper tubular, to torque a connection of the upper tubular to a lower tubular;

a torque linkage extending at least partially vertically from the tong, the torque linkage being configured to transmit a force or force-pair, or pure torque, generated by the tong applying the torque to the upper tubular;

a transmission plate removably coupled to the torque linkage so as to transmit linear forces thereto, therefrom, or both, wherein the transmission plate is configured to receive the lower tubular therethrough; and a landing plate removably coupled to the transmission plate and configured to engage the lower tubular, wherein the landing plate is configured to counteract the torque as it is applied to the lower tubular by the tong.

2. The system of claim 1, wherein the landing plate engages a coupling collar of the lower tubular.

3. The system of claim 1, further comprising a torque plate coupled to the torque linkage, wherein the transmission plate comprises sidewalls, the torque plate being configured to slide between and bear against the sidewalls, so as to removably couple the transmission plate to the torque linkage and transmit forces to the torque linkage or from the torque linkage.

4. The system of claim 3, wherein the sidewalls define channels, the torque plate being configured to slide in the channels.

5. The system of claim 1, wherein the torque linkage comprises first and second arms that are vertically aligned and horizontally offset, wherein the first and second arms are coupled to the transmission plate, such that the first and second arms are substantially in compression or substantially in tension when torque is applied by the tong to the upper tubular.

6. The system of claim 1, wherein the torque linkage comprises a vertical post and at least two arms that are pivotally connected to the vertical post, such that the arms are each substantially in compression or substantially in tension.

7. The system of claim 6, wherein the arms are each in either pure compression or pure tension.

8. The system of claim 6, further comprising a load cell and two bellcranks, the load cell being connected between the two bellcranks, wherein the two arms are connected to the two bellcranks, respectively, so as to pivot therewith.

9. The system of claim 1, wherein the landing plate comprises a torque-transmission feature that engages a coupling collar of the lower tubular and transmits a force generated by torque on the coupling collar to the transmission plate.

10. The system of claim 9, wherein the coupling collar comprises a torque-transmission feature that engages the torque-transmission feature of the landing plate.

11. The system of claim 10, wherein the torque-transmission feature of the collar comprises a plurality of splines extending radially outward, and wherein the torque-transmission feature of the landing plate comprises a plurality of splines shaped to receive the plurality of splines of the lower tubular therein, so as to transfer torque on the lower tubular to lateral forces on the landing plate.

12. The system of claim 9, wherein the landing plate comprises a pair of landing plates that each include a substantially semicircular cutout, wherein the lower tubular is received through the cutouts.

13. The system of claim 12, wherein the torque-transmission feature of the landing plate comprises a plurality of splines defined in an inner diameter surface of the cutouts.

14. The system of claim 12, wherein the pair of landing plates are pinned to the transmission plate so as to transmit forces thereto.

15. The system of claim 1, wherein substantially no side loads are incident on the lower tubular or the torque linkage.

16. The system of claim 1, wherein the landing plate is configured to support at least a portion of a weight of the lower tubular, and wherein the landing plate is coupled to a rotary table, a spider, or a rig floor.

17. The system of claim 1, further comprising a stand that supports the transmission plate, the stand being coupled to a rotary table, a spider, or a rig floor.

18. A method for reacting torque, comprising:

receiving a lower tubular partially into a wellbore, wherein an upper end of the lower tubular segment is connected to a collar;

supporting a weight of the lower tubular by engagement between a landing plate of a tubular connection system and the collar;

lowering an upper tubular into engagement with the collar;

receiving a tong of a tubular connection system around the upper tubular, wherein the tubular connection system further comprises:

a torque linkage extending at least partially vertically from the tong; and a transmission plate removably coupled to the torque linkage so as to transmit linear forces thereto, therefrom, or both, wherein the landing plate is removably coupled to the transmission plate; and rotating the upper tubular relative to the lower tubular and the collar using the tong so as to connect the upper tubular to the lower tubular via the collar, wherein the torque is reacted from the tong, through the torque linkage and the transmission plate, and from the lower tubular through the landing plate and to the transmission plate.

19. The method of claim 18, wherein receiving the tong of the tubular connection system around the upper tubular comprises sliding a torque plate connected to the torque linkage into connection with the landing plate.

20. The method of claim 18, wherein the torque is reacted without producing a substantial side load or bending torque on the lower tubular.

21. A tubular connecting system, comprising:

a tong configured to apply a torque on an upper tubular, to torque a connection of the upper tubular to a lower tubular;

a torque linkage extending at least partially vertically from the tong, the torque linkage being configured to transmit a force or force-pair, or pure torque, generated by the tong applying the torque to the upper tubular, wherein the torque linkage comprises first and second arms that are vertically aligned and horizontally offset;

a transmission plate removably coupled to the torque linkage so as to transmit linear forces thereto, therefrom, or both, wherein the transmission plate is configured to receive the lower tubular therethrough, and wherein the first and second arms are coupled to the transmission plate, such that the first and second arms are substantially in compression or substantially in tension when torque is applied by the tongs to the upper tubular; and a landing plate removably coupled to the transmission plate and configured to engage the lower tubular, wherein the landing plate is configured to counteract the torque being applied to the lower tubular by the tong, and wherein the landing plate comprises a torque-transmission feature that engages a coupling collar of the lower tubular and reacts a force generated by torque on the coupling collar to the transmission plate.

22. The system of claim 21, further comprising a torque plate coupled to the torque linkage, wherein the transmission plate comprises a pair of sidewalls, the torque plate being configured to slide between and bear against the pair of sidewalls, so as to removably couple the transmission plate to the torque linkage and transmit forces to the torque linkage or from the torque linkage.

* * * * *